US006892977B2

(12) United States Patent
Boone et al.

(10) Patent No.: US 6,892,977 B2
(45) Date of Patent: May 17, 2005

(54) METHOD AND APPARATUS FOR DISPENSING ROLL STOCK MATERIAL

(75) Inventors: Chris L. Boone, Porters Lake (CA); Arthur P. Schnare, Lake Echo (CA); Brian P. Donohoe, Palgrave (CA)

(73) Assignee: Day Nite Neon Signs Ltd., Dartmouth (CA)

( * ) Notice: Subject to any disclaimer, the term of this patent is extended or adjusted under 35 U.S.C. 154(b) by 0 days.

(21) Appl. No.: 10/190,973

(22) Filed: Jul. 8, 2002

(65) Prior Publication Data

US 2003/0029960 A1 Feb. 13, 2003

(51) Int. Cl.[7] ..... B65H 75/00

(52) U.S. Cl. ..... 242/595.1; 242/596.8; 242/564.5; 242/563; 242/554.5; 242/595

(58) Field of Search ..... 242/557, 595.1, 242/596.8, 564.5, 566, 554.5, 563, 564, 564.3, 595, 611

(56) References Cited

U.S. PATENT DOCUMENTS

| | | | | | |
|---|---|---|---|---|---|
| 1,515,824 | A | * | 11/1924 | Best | 242/557 |
| 2,225,230 | A | * | 12/1940 | Ott | 280/234 |
| 2,451,620 | A | | 9/1946 | Holmes | 193/42 |
| 2,834,558 | A | * | 5/1958 | Halpin | 242/527.5 |
| 3,472,463 | A | * | 10/1969 | Fedor et al. | 242/560.2 |
| 3,685,760 | A | * | 8/1972 | Fedor | 242/560.2 |
| 3,743,205 | A | | 7/1973 | Misrach | 242/68.7 |
| 3,931,940 | A | | 5/1974 | Raighn et al. | 242/56 |
| 3,955,772 | A | | 5/1976 | Chisholm et al. | 242/78.7 |
| 4,160,528 | A | * | 7/1979 | Malone et al. | 242/527.6 |
| 4,291,845 | A | | 9/1981 | Van Cleave | 242/78.7 |
| 4,461,431 | A | * | 7/1984 | Wiley et al. | 242/563.1 |
| 4,632,326 | A | | 12/1986 | Boote et al. | 242/55.3 |
| 4,660,399 | A | | 4/1987 | Suter et al. | 72/181 |
| 4,872,247 | A | | 6/1988 | Nakamura et al. | 29/125 |
| 4,832,263 | A | * | 5/1989 | Poynor | 239/197 |
| 4,979,692 | A | | 12/1990 | Julian | 242/78.6 |
| 5,096,135 | A | * | 3/1992 | Eichenberger et al. | 242/557 |
| 5,147,170 | A | | 9/1992 | Detrick | 414/492 |
| 5,167,376 | A | * | 12/1992 | Boldrini et al. | 242/562 |
| 5,197,688 | A | * | 3/1993 | Giorgio et al. | 242/562 |
| 5,211,351 | A | * | 5/1993 | DeClerck | 242/595.1 |
| 5,376,959 | A | * | 12/1994 | Rall | 347/104 |
| 5,524,415 | A | * | 6/1996 | Pachinger et al. | 53/203 |
| 5,722,453 | A | * | 3/1998 | Huxhold | 137/355.28 |
| 5,746,077 | A | * | 5/1998 | Zaccagni et al. | 72/183 |
| 5,934,604 | A | * | 8/1999 | Klimek | 242/559.4 |
| 6,059,220 | A | * | 5/2000 | Lassiter | 242/557 |
| 6,471,154 | B1 | * | 10/2002 | Toth | 242/421.3 |

FOREIGN PATENT DOCUMENTS

| | | | |
|---|---|---|---|
| JP | 355111342 A | * | 8/1980 |
| JP | 358162466 A | * | 9/1983 |
| JP | 406047438 A | * | 2/1994 |

* cited by examiner

*Primary Examiner*—Donald P. Walsh
*Assistant Examiner*—Jonathan R Miller
(74) *Attorney, Agent, or Firm*—Dinsmore & Shohl LLP

(57) ABSTRACT

A dispenser for dispensing roll stock material comprises a pair of rollers for receiving the roll stock material, the pair of rollers being axially offset. A base supports the pair of rollers and a wheel assembly is coupled to the base. The wheel assembly enables movement of the dispenser and rotation of the pair of rollers causes the roll stock material to be unrolled. The rollers are driven by a drive mechanism to deliver a free end of material to a workstation for processing.

28 Claims, 6 Drawing Sheets

METHOD AND APPARATUS FOR DISPENSING ROLL STOCK MATERIAL

FIELD OF THE INVENTION

The present invention relates generally to an apparatus for dispensing roll stock material, and in particular to an apparatus for transporting and dispensing roll stock material.

BACKGROUND OF THE INVENTION

Many different industries use sheet material, such as aluminum, steel or plastics including acrylic and polycarbonate, to produce end products. Operations such as stamping, routing and forming are employed to process the sheet material into the desired end product. The industrial sign production industry uses high volumes of sheet material to produce large scale signs and letters. Sheet material is available from suppliers in two forms: roll stock and pre-cut sheets. Roll stock is considerably less expensive than pre-cut sheets, however, additional labour is required at the manufacturing facility to cut the roll stock into individual sheets prior to processing.

Currently, multiple rolls of roll stock material are stored at the manufacturing facility on a series of racks. A forklift is required at the time of delivery to lift each roll onto the rack. Once the roll stock is on the rack, the material is dispensed by manually unrolling a desired amount and cutting it from the roll. The cut sheet is then carried to a workstation where it will be formed, routed or stamped, for example. The dispensing and moving process is labour intensive and typically requires the assistance of three or four workers. In addition, material is wasted because excess material from a cut sheet cannot be re-attached to the roll for later use.

It is therefore an object of the present invention to provide a method and apparatus for dispensing roll stock material, which obviates or mitigates at least one of the above disadvantages.

SUMMARY OF THE INVENTION

According to one aspect of the present invention there is a dispenser for dispensing roll stock material, the dispenser comprising:

- a pair of rollers for receiving the roll stock material, the pair of rollers being axially offset from one another;
- a base for supporting the pair of rollers;
- a wheel assembly coupled to the base, the wheel assembly for enabling movement of the dispenser; and
- wherein rotation of the pair of rollers causes the roll stock material to be unrolled.

According to yet another aspect of the present invention there is provided a method for dispensing roll stock material, the method comprising:

- placing the roll stock material on a pair of rollers, the pair of rollers being offset from one another and supported by a base; and rotating the pair of rollers in a first direction to unroll the roll stock material and advance a free end of the roll stock material toward a working surface of a workstation.

The present invention provides advantages in that the time and effort required to unload a roll of material and move the material to a workstation for processing is reduced.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENTS

Figure 1:
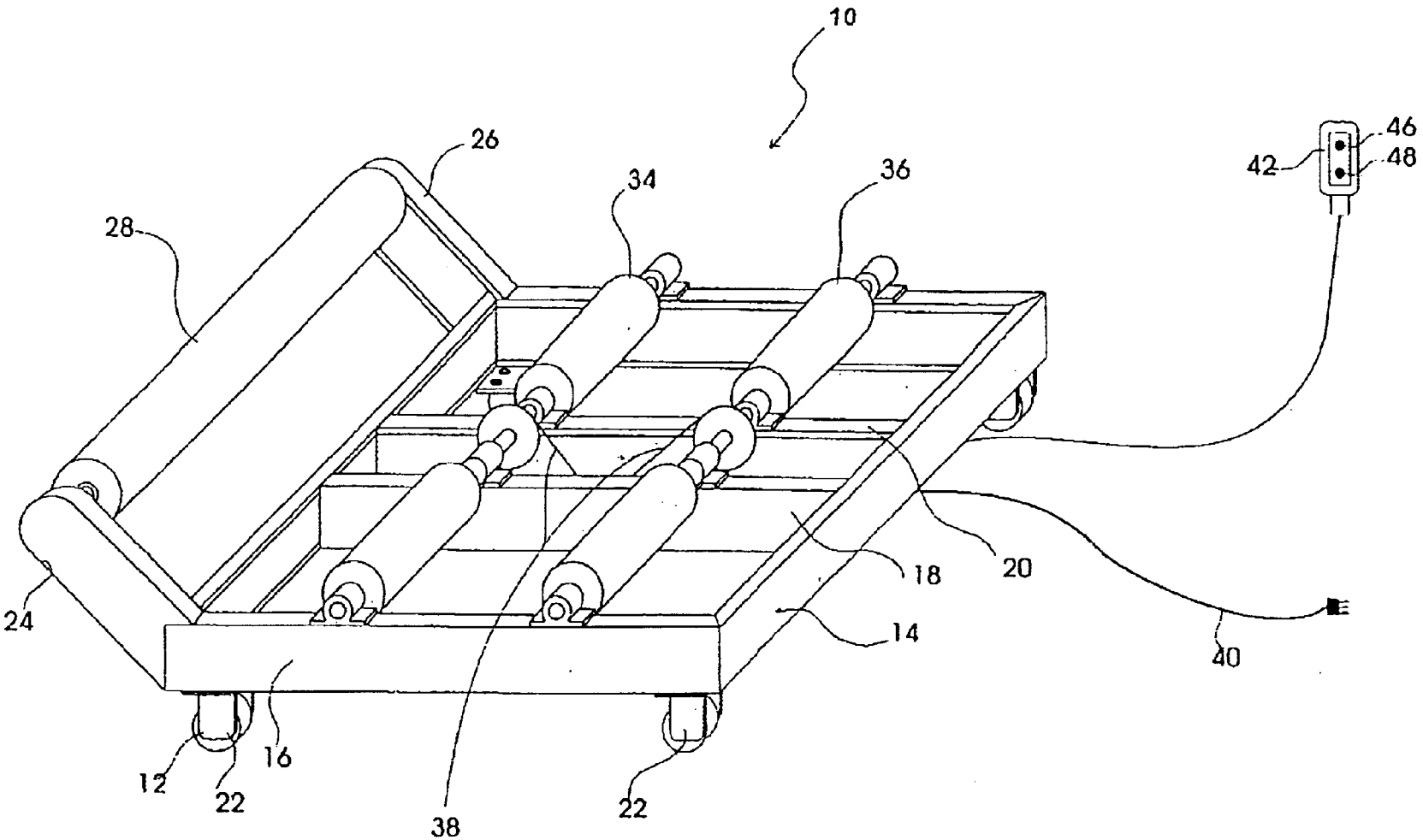
FIG. 1 is an isometric side view of a roll stock dispenser in accordance with the present invention.
Figure 2:
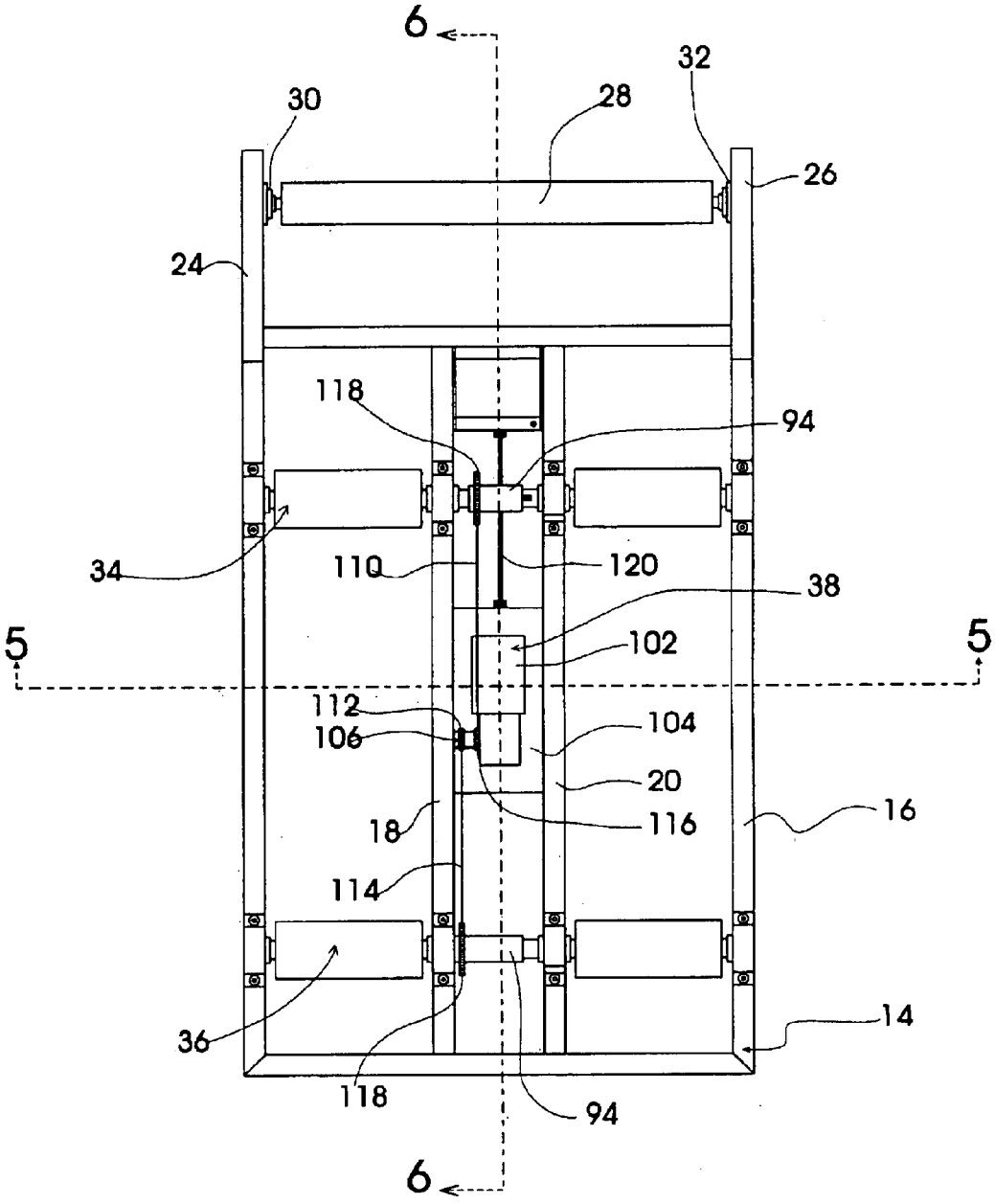
FIG. 2 is a top view of the dispenser of FIG. 1.

Referring now to FIG. 1, a dispenser for dispensing roll stock material is generally indicated at 10. The dispenser 10 includes a wheel assembly 12 that supports a base 14. The base 14 includes an outer frame 16 and first and second cross-members 18, 20 that divide the outer frame 16. The cross-members 18, 20 are welded to the outer frame 16. The base 14 and cross-members 18, 20 are generally U-shaped channels comprised of steel.

The wheel assembly 12 includes four castors 22 that are secured to the outer frame 16 of the base 14. Each castor 22 is welded to the underside of the outer frame 16 generally at a corner thereof. The castors 22 alternatively could be coupled to the outer frame 16 using suitable fasteners.

A support roller 28 is located at a forward end of the dispenser 10. Arms 24, 26 extend upwardly from the base 14 at an angle of approximately 45 degrees. The arms 24, 26 are generally U-shaped channels that are welded to the base 14. The support roller 28 is mounted on bearings 30, 32 and extends between the arms 24, 26. The bearings 30, 32 allow for free rotation of the support roller 28. The support roller 28 is generally comprised of steel having a bonded sheet rubber coating. The support roller 28 supports a free end 132, shown in FIG. 6, of the roll of material 130. Preferably, the arms 24, 26 are of a length that allows the support roller 28 to be positioned approximately at the height of a working surface of a workstation such as router machine, for example.

First and second roller assemblies 34 and 36 are mounted on the base 14 to receive the roll of material 130. The roller assemblies 34, 36 are axially offset from one another and extend across the outer frame 16 generally perpendicular to the cross-members 18, 20. The distance between the roller assemblies 34, 36 is determined by the size of roll stock that the dispenser 10 is intended to dispense. A drive mechanism for driving the roller assemblies 34, 36 is generally indicated at 38. The drive mechanism 38 is powered by a power source (not shown) via a power cord 40.

A hand-held control device 42 controls the drive mechanism 38. The hand-held control device 42 is connected to the drive mechanism 38 through a cord 44. Buttons 46 and 48 are provided on the hand-held control device 42. Button 46 corresponds to a "start" control and button 48 corresponds to a "stop" control. A switch (not shown) is provided to select the direction of rotation of the roller assemblies 34, 36. Additional buttons may be included to control the speed of the roller assemblies 34, 36, for example.

Referring to FIGS. 2 to 6, the roller assemblies 34, 36 and drive mechanism 38 will now be described.

Figure 3:
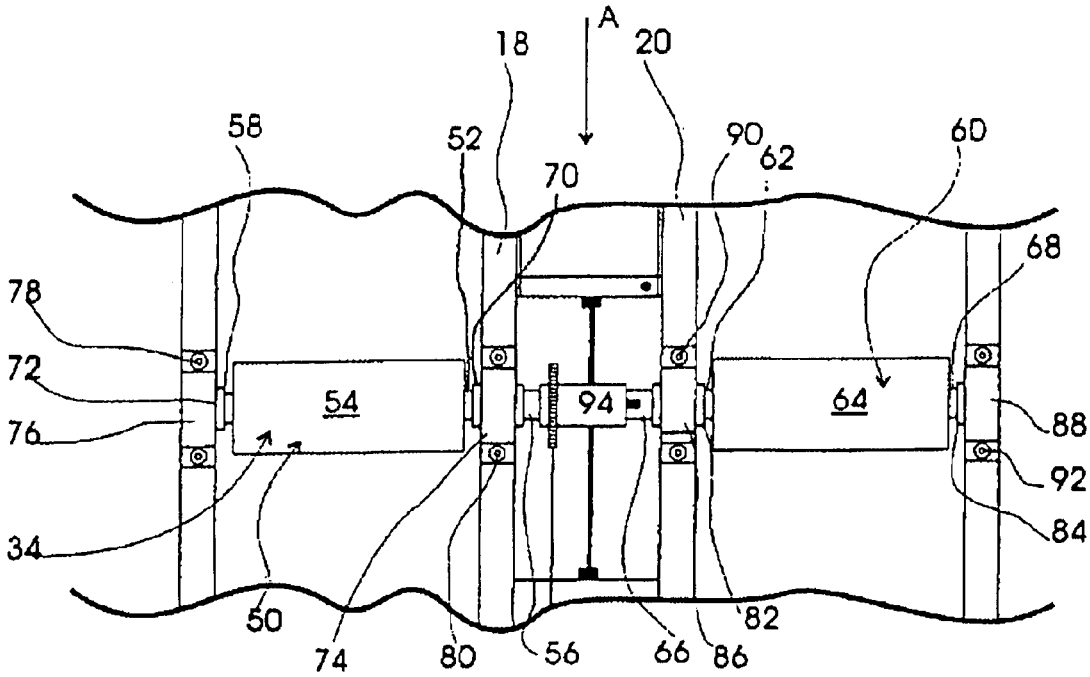
FIG. 3 is an enlarged view of a roller assembly of FIG. 2.

The first roller assembly 34 comprises a first roller 50 having a first shaft 52, as shown in FIG. 3. The first shaft 52 extends through a first roller body 54 and includes a mating end 56 and an opposing end 58. A second roller 60 includes a second shaft 62 that extends through a second roller body 64. The second roller 60 similarly includes a mating end 66 and an opposing end 68. The first and second rollers 50, 60 are arranged in series with mating ends 56 and 66 in abutment with one another. The rollers 50 and 60 are steel, which is coated with urethane to minimize slipping of the material relative to the roller assemblies 34, 36.

Bearings 70 and 72 support the first shaft 52 of first roller 50 at mating and opposing ends 56 and 58 thereof. The bearings 70 and 72 are received in bearing mounts 74 and 76. Bearing mount 76 is secured to the outer frame 16 by fasteners 78. Bearing mount 74 is secured to the first cross-member 18 by fasteners 80. Similarly, bearings 82 and 84 support the second shaft 62 of second roller 60 at mating and opposing ends 66, 68 thereof. The bearings 82 and 84 are received in bearing mounts 86 and 88, which are secured to the second cross-member 20 and outer frame 16, respectively, by fasteners 90 and 92.

Figure 4:
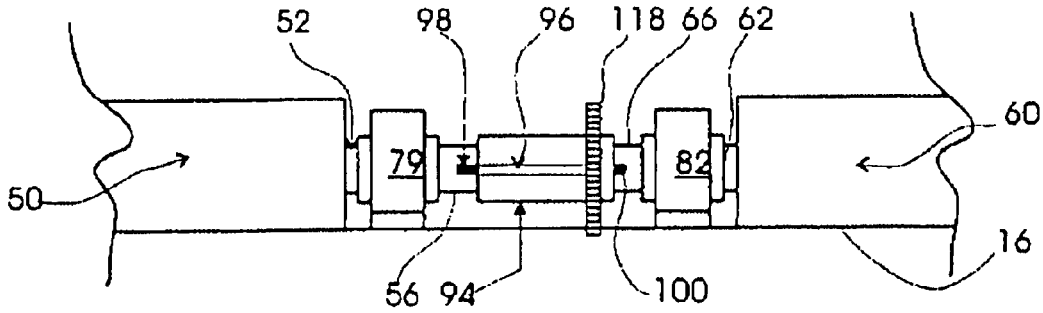
FIG. 4 is an enlarged view on A of portions of FIG. 3.
Figure 5:
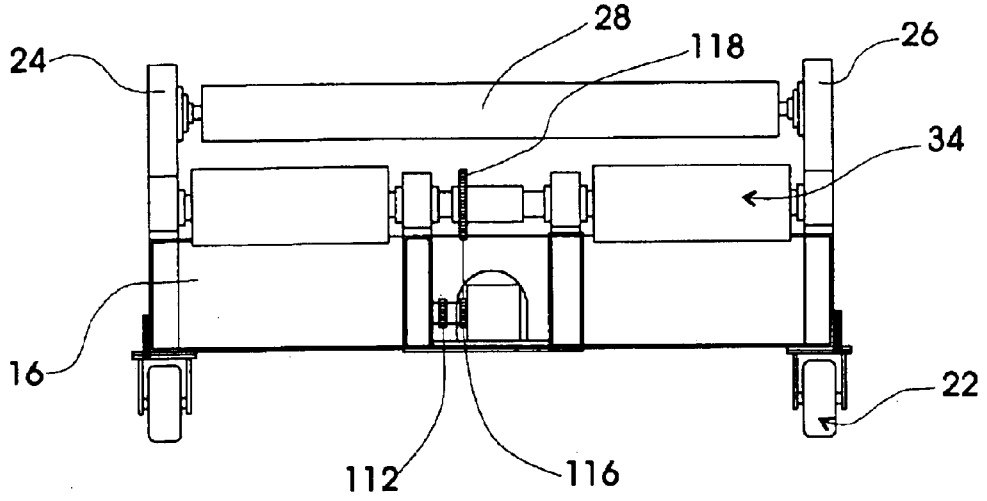
FIG. 5 is a view on 5—5 of FIG. 2.

The first and second shafts 52 and 62 are connected to one another by a coupling 94. As shown in FIG. 4, the coupling 94 includes a key 96 that fits into slots 98 and 100 that are formed in mating ends 56 and 66 of the first and second shafts 52 and 62, respectively. The coupling 94 ensures that rotational motion is transferred to the first and second shafts simultaneously.

The second roller assembly 36 is generally identical to the first roller assembly 34 and therefore will not be described. The first and second roller assemblies 34 and 36 are driven by the driving mechanism 38. Referring back to FIG. 2, the driving mechanism includes a motor 102 that is supported by a mounting plate 104. The mounting plate 104 is secured to the underside of the base 14 and extends between the first and second cross-members 18, 20. The mounting plate 104 is secured by fasteners (not shown). The mounting plate 104 may alternatively be welded to the base 14. A double sprocket 106 having a first sprocket element 112 and a second sprocket element 116 is coupled to a rotating motor output shaft 108. A first belt 110 is coupled to the first sprocket element 112 of the double sprocket 106. A second belt 114 is coupled to the second sprocket element 116 of the double sprocket 106. The belts 110, 114 are preferably chain belts, however, any belt for driving the sprocket elements 112, 116 without slipping may be used.

The first and second roller assemblies 34, 36 are each provided with a single sprocket 118, 118' that surrounds the coupling 94, 94'. The first belt 110 extends between the single sprocket 118 of the first roller assembly 34 and the first sprocket element 112. The second belt 114 extends between the single sprocket 118' of the second roller assembly 36 and the second sprocket element 116. The drive mechanism 38 further includes a connecting lead 120 that is coupled to a pull box 122 for communicating with the power supply through cord 40.

Figure 6:
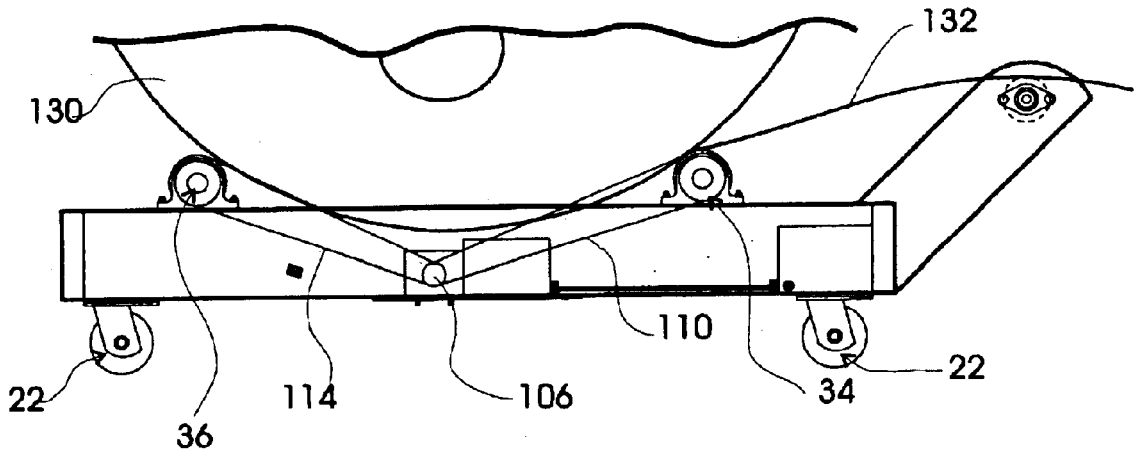
FIG. 6 is a view on 6—6 of FIG. 2 including a roll of material.

Referring to FIG. 6, the roll of material 130 is shown positioned on the roller assemblies 34 and 36 with the free end 132 resting on the support roller 28. Examples of types of roll stock material that the dispenser 10 could dispense include plastics, such as acrylics or polycarbonates, metal alloys, aluminum, and paper. Roll stock generally includes any type of material in sheet form that is wound onto a spool and stored in roll form. The roller assemblies 34, 36 are drivable in a direction to unroll the material and feed the free end 132 toward a workstation (not shown). Alternatively, the roller assemblies 34, 36 are drivable in an opposing direction to reroll the roll stock material.

In operation, the dispenser 10 is moved by an operator on castors 22 to a roll stock delivery location to receive a new roll of material 130. The dispenser 10 may be pushed using the support roller 28 as a handle. The roll of material 130 is loaded onto the dispenser 10 using a forklift or another suitable device. The roll of material is then positioned to rest along the first and second roller assemblies 34, 36, as shown in FIG. 6. Once the roll of material 130 is properly positioned, the dispenser 10 is moved on castors 22 to a workstation. The dispenser 10 is oriented so that the support roller 28 is adjacent the workstation in order to deliver the free end 132 of the roll stock material to the working surface thereof.

Once the dispenser 10 is in place, the motor 120 is actuated by the operator using the hand held control device 42. The roller assemblies 34, 36 rotate in a direction to deliver the material to the workstation. The motor 120 is stopped by the operator when a sufficient amount of material is located on the working surface of the workstation. The material is then processed in a desired manner. Following processing, the processed portion of the material is severed from the roll of material 130. The free end 132 may then be retracted by actuating the motor 120 to rotate the roller assemblies 34, 36 in a direction to re-roll the roll of material 130. Alternatively, the free end 132 may be delivered, as has been previously described, to the working surface to process another portion of the material.

Figure 7:
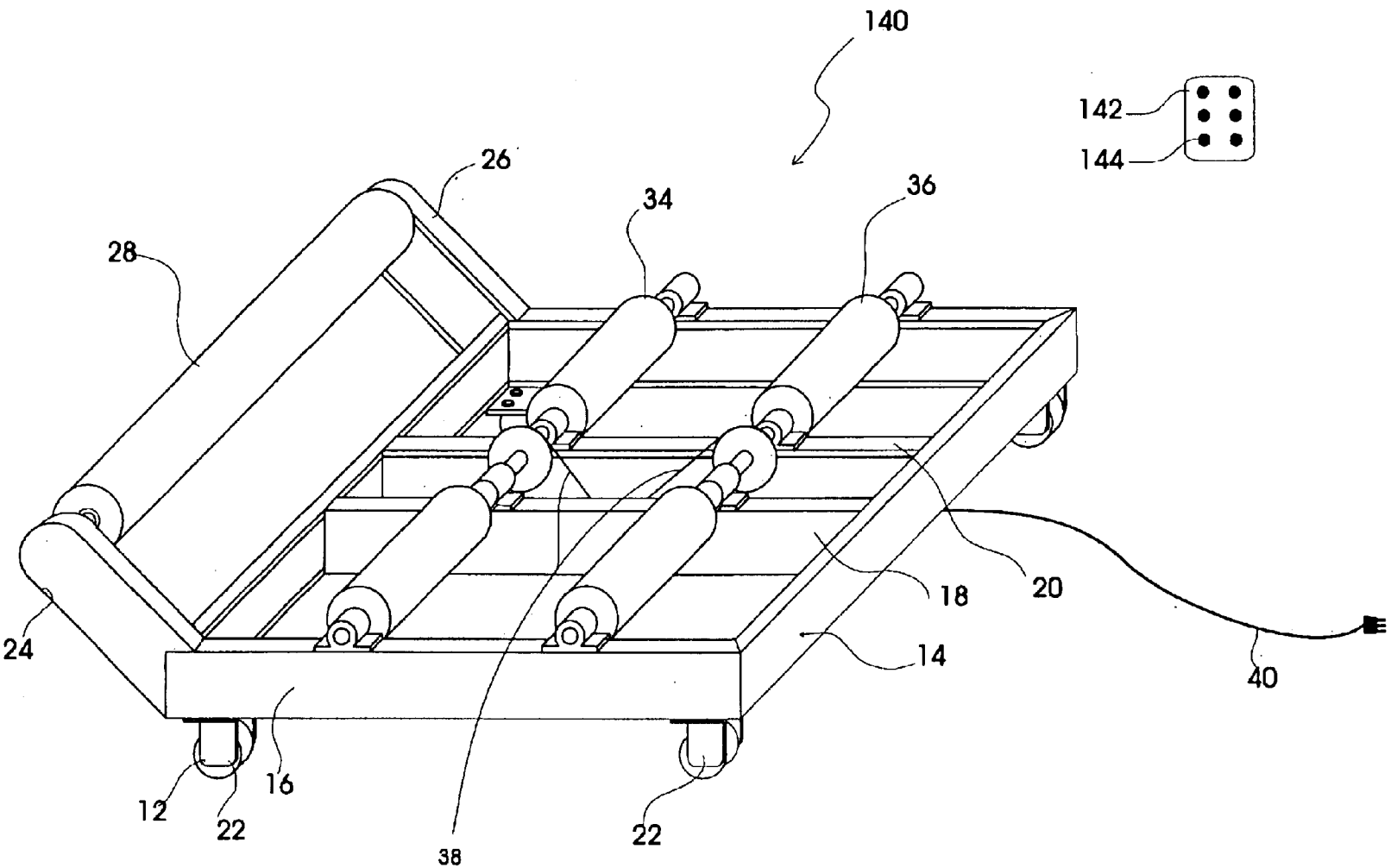
FIG. 7 is an isometric view of a second embodiment of a roll stock dispenser.

A second embodiment of a dispenser 140 is shown in FIG. 7, in which like numerals represent like parts. In this embodiment, a hand-held control device 142 remotely controls the drive mechanism 38. The hand-held control device 142 includes a plurality of buttons 144, which provide the operator with various control options including "start" and "stop". Preferably, the hand-held control 142 is a Protean radio control device manufactured by Insul-8 Corporation, however, any suitable remote control device may be used.

Figure 8:
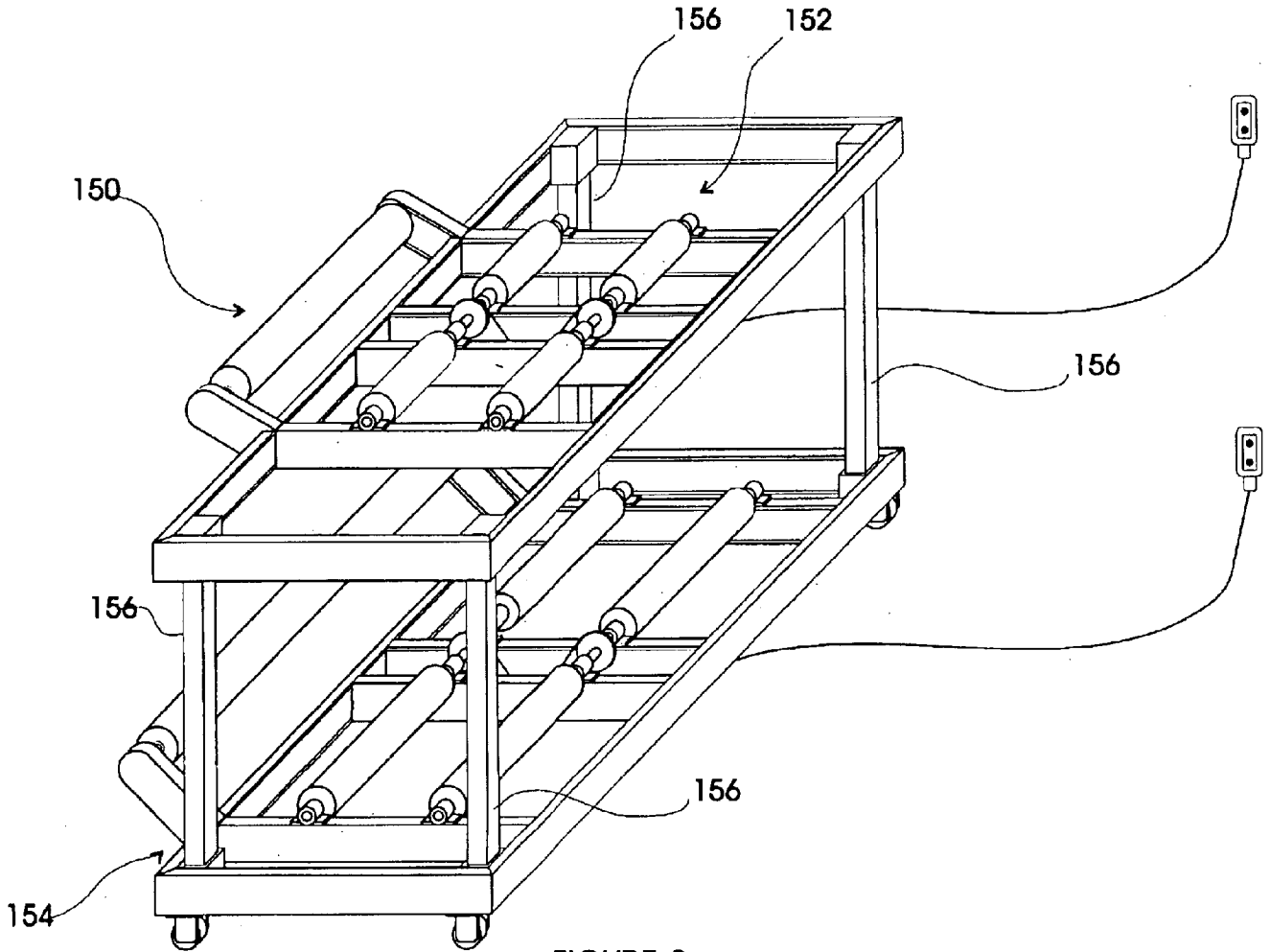
FIG. 8 is an isometric side view of a third embodiment of a roll stock dispenser.

A third embodiment of a dispenser 150 is shown in FIG. 8. The dispenser 150 includes a first dispenser 152 stacked upon a second dispenser 154. The first dispenser 152 is supported by struts 156 at four corners thereof. The struts 156 have a generally square cross-section. The principles of construction of the first and second dispensers 152 and 154 individually have been described herein in relation to the dispenser 10. As shown, the sizes of the components of the dispenser 10 may be altered to suit each particular application.

It will be appreciated by a person skilled in the art that the roller assemblies 34, 36 may each be comprised of a single roller and the driving mechanism 38 may be coupled to an end of each of the rollers. It will further be appreciated that the support roller is optional and therefore could be omitted without affecting the operation of the dispenser 10.

In a further alternative embodiment, the wheel assembly 12 of the dispenser 10 may be driven by a motor. This would further reduce the amount of labour required because manual re-location of the dispenser 10 would no longer be necessary.

Although preferred embodiments of the present invention have been described, those of skill in the art will appreciate that variations and modifications may be made without departing from the spirit and scope thereof as defined by the appended claims.

We claim:

1. A dispenser for dispensing roll stock material, said dispenser comprising:

a first roller assembly and a second roller assembly for receiving said roll stock material such that said roll stock material is positioned to rest on said first roller assembly and said second roller assembly, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled.

2. A dispenser as claimed in claim 1, wherein said driven element is a sprocket.

3. A dispenser as claimed in claim 1, wherein said drive comprises a belt and a motor, said belt extending between said motor and said driven element for transferring rotational motion to said at least one of said first roller assembly and said second roller assembly.

4. A dispenser as claimed in claim 3, wherein said motor has an output shaft, said belt extending between said output shaft of said motor and said driven element.

5. A dispenser as claimed in claim 4, wherein said output shaft has a driven element, said belt extending between said driven element of said output shaft of said motor and said driven element of said at least one of said first roller assembly and said second roller assembly.

6. A dispenser as claimed in claim 3, wherein said belt is a chain belt.

7. A dispenser as claimed in claim 1, wherein said at least two rollers are a first roller and a second roller.

8. A dispenser as claimed in claim 1, wherein said first roller assembly has a first roller and a second roller and said second roller assembly has a first roller and a second roller, each roller assembly has said driven element interposed between said first roller and said second roller.

9. A dispenser as claimed in claim 8, wherein said drive comprises a first belt, a second belt and a motor, said first belt extending between said motor and said driven element of said first assembly and said second belt extending between said motor and said driven element of said second assembly for transferring rotational motion to said first roller assembly and said second roller assembly.

10. A dispenser as claimed in claim 9, wherein said motor has an output shaft, said belts extending between said output shaft of said motor and said driven elements.

11. A dispenser as claimed in claim 10, wherein said output shaft has a first driven element and a second driven element, said first belt extending between said first driven element of said output shaft of said motor and said driven element of said first roller assembly and said second belt extending between said second driven element of said output shaft of said motor and said driven element of said second roller assembly.

12. A dispenser as claimed in claim 9, wherein said belt is a chain belt.

13. A dispenser as claimed in claim 1, wherein said driven element of said at least one of said first roller assembly and said second roller assembly is coupled to said coupling of said at least one of said first roller assembly and said second roller assembly.

14. A stacked dispenser comprising at least one dispenser for dispensing roll stock material stacked upon further dispenser for dispensing roll stock material, each dispenser comprising:

a first roller assembly and a second roller assembly for receiving said roll stock material, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly, wherein said base further comprises at least one support member to provide additional support for said at least one of said first roller assembly and said second roller assembly;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled.

15. A dispenser as claimed in claim 1, wherein said base further comprises at least one support member to provide additional support for said at least one of said first roller assembly and said second roller assembly.

16. A dispenser as claimed in claim 15, wherein said at least one support member is one support member.

17. A dispenser as claimed in claim 15, wherein said at least one support member is a first support member and a second support member.

18. A dispenser as claimed in claim 17, wherein said coupling is interposed between said first support member and said second support member.

19. A dispenser as claimed in claim 1, wherein said first roller assembly and said second roller assembly are rotatable in an opposing direction for retracting a free end of said roll stock material.

20. A dispenser as claimed in claim 1 further comprising a wheel assembly coupled to said base, said wheel assembly for enabling movement of said dispenser.

21. A dispenser for dispensing roll stock material, said dispenser comprising:

a first roller assembly and a second roller assembly for receiving said roll stock material, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly, wherein said base further comprises one support member to provide additional support for said at least one of said first roller assembly and said second roller assembly, said at least one of said first roller assembly and said second roller assembly having a first roller and a second roller, one end of said first roller being coupled to said base, other than to said one support member, and an other end of said first roller being coupled to said one support member; and one end of said second roller being coupled to said base, other than to said one support member;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled.

22. A dispenser for dispensing roll stock material, said dispenser comprising:

a first roller assembly and a second roller assembly for receiving said roll stock material, said first roller assembly and said second roller assembly each having a first roller and a second roller; arranged in series that are in communication with one another through a coupling, said first roller assembly and said second roller assembly being axially offset from one another;

a base for supporting said first roller assembly and said second roller assembly, wherein said base further comprises one support member to provide additional support for said at least one of said first roller assembly and said second roller assembly, one end of said first roller of each assembly being coupled to said base, other than to said one support member, and an other end of said first roller of each assembly being coupled to said one support member; and one end of said second roller of each assembly being coupled to said base, other than to said one support member;

said at least one of said first roller assembly and said second roller assembly having a driven element interposed between said first roller and said second roller; and a drive coupled to said driven element for rotating said first roller and said second roller of said at least one of said first roller assembly and said second roller assembly causing said roll stock material to be unrolled.

23. A dispenser for dispensing roll stock material, said dispenser comprising:

a first roller assembly and a second roller assembly for receiving said roll stock material said first roller assembly and said second roller assembly each having a first roller and a second roller; arranged in series that are in communication with one another through a coupling, said first roller assembly and said second roller assembly being axially offset from one another;

a base for supporting said first roller assembly and said second roller assembly, wherein said base further comprises a first support member and a second support member to provide additional support for said first roller assembly and said second roller assembly, one end of said first roller of each assembly being coupled to said base, other than to said first and second support members, and an other end of said first roller of each assembly being coupled to said first support member; and one end of said second roller of each assembly being coupled to said base, other than to said first and second support members, and an other end of said second roller of each assembly being coupled to said second support member;

said at least one of said first roller assembly and said second roller assembly having a driven element interposed between said first roller and said second roller; and a drive coupled to said driven element for rotating said first roller and said second roller of said at least one of said first roller assembly and said second roller assembly causing said roll stock material to be unrolled.

24. A dispenser for dispensing roll stock material, said dispenser comprising:

a first roller assembly and a second roller assembly for receiving said roll stock material, said first roller assembly and said second roller assembly each having a first roller and a second roller arranged in series that are in communication with one another through a coupling, said first roller assembly and said second roller assembly being axially offset from one another;

a base for supporting said first roller assembly and said second roller assembly, wherein said base further comprises one support member being a cross-member to provide additional support for said at least one of said first roller assembly and said second roller assembly, one end of said first roller of each assembly being coupled to said base, other than to said one support member, and an other end of said first roller of each assembly being coupled to said one support member; and one end of said second roller of each assembly being coupled to said base, other than to said one support member;

said at least one of said first roller assembly and said second roller assembly having a driven element interposed between said first roller and said second roller; and a drive coupled to said driven element for rotating said first roller and said second roller of said at least one of said first roller assembly and said second roller assembly causing said roll stock material to be unrolled.

25. A dispenser for dispensing roll stock material, said dispenser comprising:

a first roller assembly and a second roller assembly for receiving said roll stock material, said first roller assembly and said second roller assembly each having a first roller and a second roller arranged in series that are in communication with one another through a coupling, said first roller assembly and said second roller assembly being axially offset from one another;

a base for supporting said first roller assembly and said second roller assembly, wherein said base further comprises a first support member said support member being a cross-member and a second support member being a cross-member to provide additional support for said first roller assembly and said second roller assembly, one end of said first roller of each assembly being coupled to said base, other than to said first and second support members, and an other end of said first roller of each assembly being coupled to said first support member; and one end of said second roller of each assembly being coupled to said base, other than to said first and second support members, and an other end of said second roller of each assembly being coupled to said second support member;

said at least one of said first roller assembly and said second roller assembly having a driven element interposed between said first roller and said second roller; and a drive coupled to said driven element for rotating said first roller and said second roller of said at least one of said first roller assembly and said second roller assembly causing said roll stock material to be unrolled.

26. A dispenser for dispensing roll stock material, said dispenser comprising:

a first roller assembly and a second roller assembly for receiving said roll stock material, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled, wherein operation of said drive is controlled by an operator using a hand held control device.

27. A dispenser for dispensing roll stock material, said dispenser comprising:

a first roller assembly and a second roller assembly for receiving said roll stock material, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly, said base further comprising a support roller coupled to a dispensing end of said base, said support roller for supporting a free end of said roll stock material;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled.

28. A stacked dispenser comprising at least one dispenser for dispensing roll stock material stacked upon further dispenser for dispensing roll stock material each dispenser comprising:

a first roller assembly and a second roller assembly for receiving said roll stock material, at least one of said first roller assembly and said second roller assembly having at least two rollers arranged in series that are in communication with one another through a coupling, said first roller assembly and said second roller assembly being axially offset from one another;

a base for supporting said first roller assembly and said second roller assembly;

said at least one of said first roller assembly and said second roller assembly having a driven element interposed between said at least two rollers; and a drive coupled to said driven element for rotating said at least two rollers of said at least one of said first roller assembly and said second roller assembly causing said roll stock material to be unrolled.

* * * * *

UNITED STATES PATENT AND TRADEMARK OFFICE

CERTIFICATE OF CORRECTION

PATENT NO. : 6,892,977 B2
DATED : May 17, 2005
INVENTOR(S) : Chris L. Boone et al.

It is certified that error appears in the above-identified patent and that said Letters Patent is hereby corrected as shown below:

Column 8,
Line 33, delete "said support member".

Signed and Sealed this

Thirtieth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,892,977 B2
APPLICATION NO. : 10/190973
DATED : May 17, 2005
INVENTOR(S) : Chris E. Boone It is certified that error appears in the above-identified patent and that said Letters Patent is hereby corrected as shown below:

On the Title Page, Item (75) Inventors: "Chris L. Boone, Porters Lake (CA)" should read --Chris E. Boone, Porters Lake (CA)--.

Signed and Sealed this
Eleventh Day of March, 2014

Michelle K. Lee

Michelle K. Lee
*Deputy Director of the United States Patent and Trademark Office*